US008286516B2

(12) United States Patent
Routeau et al.

(10) Patent No.: US 8,286,516 B2
(45) Date of Patent: Oct. 16, 2012

(54) DEVICE FOR MEASURING THE MOVEMENT OF A SUBSEA DEFORMABLE PIPELINE

(75) Inventors: Sylvain Routeau, Saint Cloud (FR); Isabelle Clement, Massy (FR); Frédéric Demanze, Chaville (FR)

(73) Assignee: Technip France (FR)

( * ) Notice: Subject to any disclaimer, the term of this patent is extended or adjusted under 35 U.S.C. 154(b) by 331 days.

(21) Appl. No.: 12/742,522

(22) PCT Filed: Nov. 4, 2008

(86) PCT No.: PCT/FR2008/001552

§ 371 (c)(1),
(2), (4) Date: May 12, 2010

(87) PCT Pub. No.: WO2009/092908

PCT Pub. Date: Jul. 30, 2009

(65) Prior Publication Data

US 2010/0257949 A1 Oct. 14, 2010

(30) Foreign Application Priority Data

Nov. 13, 2007 (FR) ..... 07 07960

(51) Int. Cl.
*G01N 19/00* (2006.01)

(52) U.S. Cl. ..... 73/865.9

(58) Field of Classification Search ..... 73/865.9
See application file for complete search history.

(56) References Cited

U.S. PATENT DOCUMENTS

| | | | | |
|---|---|---|---|---|
| 4,481,902 | A | 11/1984 | Meyer et al. | |
| 6,561,714 | B1 * | 5/2003 | Williams et al. | 403/2 |
| 7,398,697 | B2 * | 7/2008 | Allen et al. | 73/800 |
| 2008/0152433 | A1 * | 6/2008 | Monti et al. | 405/184.4 |
| 2009/0313794 | A1 * | 12/2009 | Denniel et al. | 24/499 |

FOREIGN PATENT DOCUMENTS

| | | | |
|---|---|---|---|
| FR | 78 873 | E | 9/1962 |
| FR | 2 503 365 | A | 10/1982 |
| GB | 925 800 | | 5/1963 |
| UA | 24 383 | U | 6/2007 |
| WO | WO 03/058160 | A | 7/2003 |
| WO | WO 2006/102259 | A | 9/2006 |

OTHER PUBLICATIONS

International Search Report dated Jul. 24, 2009, issued in corresponding international application No. PCT/FR2008/001552.

* cited by examiner

*Primary Examiner* — Hezron E Williams
*Assistant Examiner* — Rodney T Frank
(74) *Attorney, Agent, or Firm* — Ostrolenk Faber LLP

(57) ABSTRACT

A method and a device for measuring the movement of a subsea pipeline. The measuring device has an accommodating mount anchored in the sea bed to accept the subsea pipeline. The subsea pipeline is liable to be made to move over a determined travel with respect to the accommodating support as the pipelines deforms. The movement has an amplitude that varies according to the deformation of the subsea pipeline. A plurality of frangible elements secured to one of either the deformable subsea pipeline and the accommodating mount. The frangible elements are intended to be broken in succession by the other of either the deformable subsea pipeline and the accommodating mount when the pipeline is caused to move.

12 Claims, 2 Drawing Sheets

DEVICE FOR MEASURING THE MOVEMENT OF A SUBSEA DEFORMABLE PIPELINE

CROSS REFERENCE TO RELATED APPLICATION

The present application is a 35 U.S.C. §§371 national phase conversion of PCT/FR2008/001552, filed Nov. 4, 2008, which claims priority of French Application No. 0707960, filed Nov. 13, 2007, the disclosure of which is incorporated by reference herein. The PCT International Application was published in the French language.

BACKGROUND OF THE INVENTION

The invention relates to a device for measuring the movement of a subsea deformable pipeline in relation to a sea bed.

One envisaged application field is that of on-bottom pipelines, or "flowline" pipes, that extend over the sea bed. They are intended to connect a wellhead, which projects from the sea bed, to a riser, which, from the sea bed, extends as a catenary to join a surface installation. The on-bottom pipeline, which is supported on and extends over the sea bed from the wellhead, has a connecting end for connecting the on-bottom pipeline to the riser, or to another on-bottom pipeline.

Therefore, a hydrocarbon which flows from the wellhead is brought up to the surface installation via the on-bottom pipeline and the riser.

Other technical fields are envisaged where a flexible pipeline is liable to deform under the effect of the thermal and/or mechanical variations of a liquid passing through it.

The hydrocarbons flow from the wellhead at a pressure and a temperature that vary over time. Moreover, when the flow has stopped, for any reason due to the operation, the pressure and temperature conditions of the on-bottom pipeline change dramatically. As a result, the on-bottom pipeline then expands or contracts when, for example, flow restarts. An on-bottom pipeline that is a thousand meters, for example, can be subject to meter-scale longitudinal dimension variations.

Thus, during the life of an oil field, which can be some years, the on-bottom pipeline is subjected to numerous expansion and retraction cycles with consequential amplitudes that bring about large stresses on the pipeline and the connecting parts.

It is known to minimise the stresses placed on the structure by designing structures that are capable of absorbing these stresses. To this end, the connecting ends are mounted on metal structures that can slide on a foundation anchored in the sea bed. In this manner, the connecting end can accommodate longitudinal movements. However, residual friction remains at the connecting ends and it is important then to assess these excursions to ensure that these stresses are compatible with the structure of the on-bottom pipeline.

It can also be envisaged to continuously monitor the behavior of the structure by recording data in real time. Thus, the lengthening of the structure can be monitored in real time and it can be determined if it is compatible with the maximum lengthening values that the connecting parts in particular can tolerate. However, this requires an expensive fragile device and a connection to the surface for processing the data.

Therefore, a problem that arises and which the present invention aims to solve is that of providing a device which enables the movements of a subsea deformable on-bottom pipeline to be measured and inspected, and at a favorable cost.

BRIEF DESCRIPTION OF THE INVENTION

With the aim of solving this problem, the present invention proposes a device for measuring the movement of a subsea deformable pipeline in relation to a sea bed, said subsea deformable pipeline being extended over said sea bed in order to transport liquids between two on-bottom installations, said subsea deformable pipeline being liable to deform according to the temperature of the liquids transported. The measuring device comprises an accommodating support anchored in said sea bed between said installations to accept said subsea deformable pipeline. When it deforms, subsea deformable pipeline is liable to be made to move over a determined travel with respect to the accommodating support. That movement has an amplitude that varies according to the deformation of said subsea pipeline. According to the invention, the device further comprises a collection or plurality of frangible elements secured to one of either of said subsea deformable pipeline and said accommodating support. The collection of frangible elements are arrayed along a mean direction that is substantially parallel with said determined travel. The frangible elements are intended to be broken in succession by the other of either of said subsea deformable pipeline and said accommodating support when said pipeline is caused to move over said determined travel, a measure or indication of said amplitude of said movement is a function of the number of broken frangible elements.

Therefore, one feature of the invention is the implementation of a collection of frangible elements, that can be located and observed, which, when the subsea deformable pipeline deforms both longitudinally and laterally, are broken in succession; wherein the number of broken frangible elements depends on the maximum deformation amplitude of the pipeline. Indeed, since the collection of frangible elements extends in and is arrayed along a direction that is parallel to the pipeline movement travel, the greater the deformation amplitude, the greater the number of broken frangible elements. The device in accordance with the invention therefore enables the measurement, by means of a viewing camera on board a robot for example, of the maximum amplitude, or maximum excursion, that occurs during the life of the oil field. This data is then compared with the values calculated during the design of the subsea on-bottom pipeline and the connecting ends thereof, in order to assess if they are compatible with the friction hypotheses put forward. Furthermore, such a measuring device is relatively inexpensive as it is extremely simple, and moreover it is reliable and robust. Furthermore, the measuring device in accordance with the invention cannot only be installed between a riser and an on-bottom pipeline, but also between two on-bottom pipelines.

According to a particularly advantageous embodiment of the invention, said collection of frangible elements includes rods, each rod having an end engaged in said subsea deformable pipeline or in said accommodating support and a free end projecting from said subsea deformable pipeline or from said accommodating support. In this manner, when the subsea pipeline deforms and is made to move, respectively, said accommodating support or said subsea deformable pipeline bears against the free ends of the rods and breaks them by shearing in synchronism with the relative movement of the subsea pipeline and said accommodating support. Advantageously, said rods have a groove or notch forming an incipient fracture, and this enables a brittle break of the rods when they are deformed by the relative movement of said accommodating support and the subsea pipeline. For better viewing, the free end of the rods is colored with a color that is distinct from the color of the sea bed, such that the images generated by the observation camera do not give rise to any doubt on the breakage or non-breakage of a rod. Indeed, when the rod is intact, the colored free end thereof appears clearly in the initial position thereof on the images of the observation camera. By contrast, when the rod has been broken, the colored free end thereof has generally been carried off by the on-bottom subsea currents, such that the remainder of the engaged broken rod simply shows a dot having a different color that contrasts with the other colored ends which remain intact.

Furthermore, each rod is kept oriented in its own direction that is substantially perpendicular to said determined travel, such that said subsea deformable pipeline or said accommodating support according to the embodiment, which bears on the free ends of rods, breaks the rods with maximum effectiveness. Furthermore, said rods are mounted and screwed into said one of either of said subsea deformable pipeline and said accommodating support, such as to make the mounting thereof simpler. Preferably, said rods are made of plastic, for example polyamide. In this manner, since this material is relatively rigid, and brittle, a minimum deformation of the rods causes the breakage thereof, and more specifically at the notch.

According to a particularly advantageous embodiment, said collection of frangible elements has at least one line of said rods, that are preferably evenly spaced, in a direction that is between the direction of said travel and a direction that is perpendicular to said travel, such as to be able to establish a relationship of proportionality between the number of broken rods and the amplitude of the movement of the subsea deformable pipeline.

According to a first alternative of the invention, that is particularly advantageous, said frangible elements are secured to said accommodating support, while said subsea deformable pipeline is suitable for breaking said frangible elements. In this manner, the collection of the frangible elements is kept in a fixed position in relation to the sea bed, and it is the movements of the deformable pipeline that break the frangible elements. To this end, and according to an advantageous feature, the measuring device in accordance with the invention further comprises a carriage slidingly mounted on said accommodating support, said pipeline being mounted securely to said carriage, and said carriage is suitable for breaking said frangible elements when said subsea pipeline is made to move and it drives, thereby, the carriage.

According to a second alternative, said frangible elements are secured to said subsea deformable pipeline, while said accommodating support is suitable for breaking said frangible elements. In this manner, it is the subsea pipeline which, in deforming, drives the frangible elements, which are then broken against said accommodating support which itself is kept in a fixed position on the sea bed.

Advantageously, in accordance with this second alternative, the measuring device further comprises a sleeve that fits tightly around said subsea deformable pipeline and that supports said frangible elements. The sleeve is then totally secured to the subsea pipeline and it is slidingly mounted inside a ring anchored on the sea bed. Said ring is then suitable for breaking said frangible elements when said subsea pipeline is made to move and it drives, thereby, the sleeve through the ring.

According to another subject matter, the present invention proposes a method for measuring the movement of a subsea deformable pipeline in relation to a sea bed, said subsea deformable pipeline being extended over said sea bed in order to transport liquids between two on-bottom installations, said subsea deformable pipeline being liable to deform according to the temperature of the liquids transported, said method being of the type according to which an accommodating support is provided that is anchored in said sea bed between said installations to accept said subsea deformable pipeline, said subsea deformable pipeline being liable to be made to move over a determined travel with respect to said support when it deforms, said movement having an amplitude that varies according to the deformation of said subsea pipeline; according to the invention, the measuring method further comprises the following steps: there is provided a collection of frangible elements secured to one of either of said subsea deformable pipeline and said accommodating support, said collection of frangible elements extending in a mean direction that is substantially parallel with said determined travel, said frangible elements being intended to be broken in succession by the other of either of said subsea deformable pipeline and said accommodating support, when said pipeline is caused to move over said determined travel, said amplitude of said movement is measured as a function of the number of broken frangible elements. This measurement is carried out visually, for example by means of an observation camera which generates images that can be then observed at the surface. The measurement involves counting the number of broken frangible elements in relation to the number of frangible elements initially installed.

BRIEF DESCRIPTION OF THE DRAWINGS

Other features and advantages of the invention will emerge upon reading the following description of a particular embodiment of the invention, given indicatively but in a non-limiting manner, with reference to the appended drawings in which.

DESCRIPTION OF EMBODIMENTS

Figure 1A:
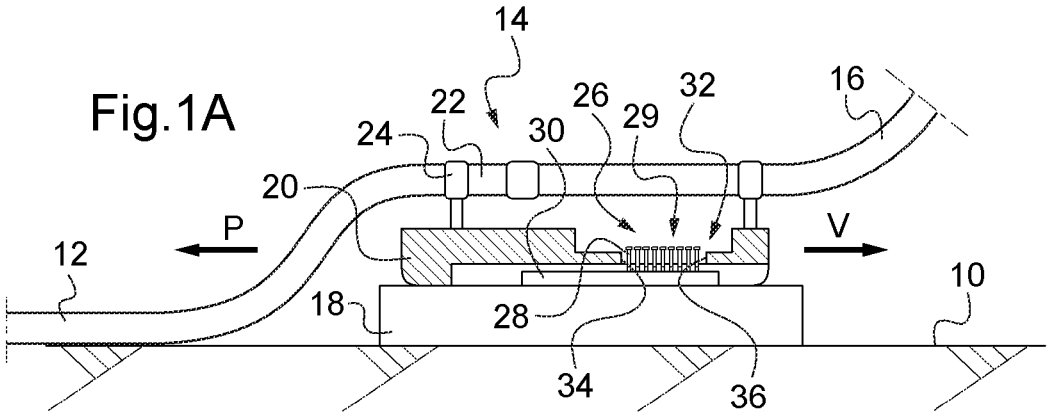
FIG. 1A is a schematic longitudinal and vertical section view of the device in accordance with the invention, according to a first alternative.
Figure 1B:
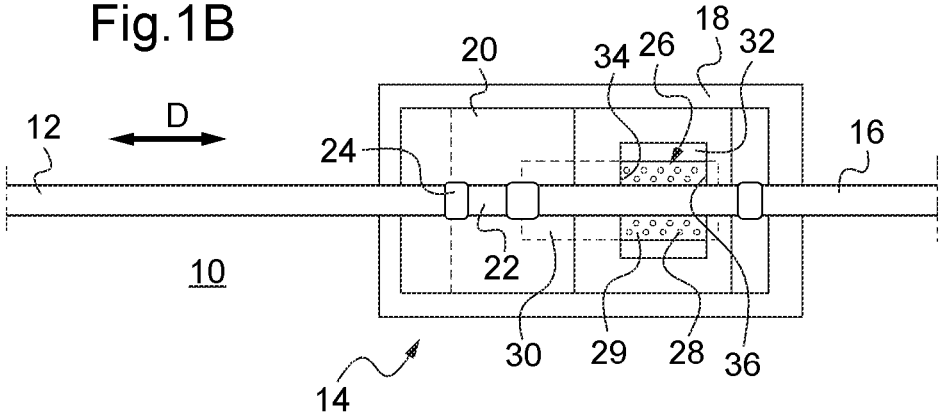
FIG. 1B is a top schematic view of the device illustrated in FIG. 1

FIGS. 1A and 1B show a sea bed 10 on which rests an on-bottom pipeline 12 extended longitudinally in a given direction, a measuring device 14 in accordance with the invention and a riser 16 intended to join a surface installation. The measuring device 14 includes an accommodating support 18 anchored in the sea bed 10. Installed on this accommodating support 18 is a carriage 20 that is longitudinally translationally moveable in a direction D that is substantially parallel with said given direction of the on-bottom pipeline 12. The carriage 20 is translationally moveable with respect to the accommodating support 18, which is provided with guiding means, that are not shown, in order to, precisely, translationally guide the carriage 20.

The on-bottom pipeline 12 has a connecting end 22 kept in a fixed position on the moveable carriage 20, via a clamp 24. Therefore, the deformations of the on-bottom pipeline 12, that are mainly linked to the thermal variations to which it is subjected, cause lengthening or retraction of this on-bottom pipeline 12 which then in turn makes the connecting end 22 move longitudinally in the direction D, and consequently, the carriage 20 to which it is secured. The carriage 20 is therefore made to move alternately over a determined travel in the course of the thermal variations of the on-bottom pipeline 12. Of course, this alternate movement of the carriage 20 can be for relatively long periods which can amount to several months or even several years. The measuring device 14 in accordance with the invention then enables the amplitude of these alternate movements to be measured by means of a collection 26 of frangible elements comprising plastic rods 28. It will be seen that the collection 26 of frangible elements extends in a mean direction that is substantially parallel with the direction of the alternate movements.

These rods 28 are made of plastic, polyamide for example, and are screwed on a front face 29 of a support plate 30, that is installed substantially horizontally on the accommodating support 18 and is fixed there. The advantage of polyamide is the rigidity thereof and, as a result, the ability thereof to fracture with a brittle break. The carriage 20 covers the support plate 30 and has a window 32 through which the rods 28 extend and project. Furthermore, the two transverse opposite edges 34, 36 of the window 32 form two opposite cutter bars that are substantially perpendicular to the direction D of movement of the carriage 20. These two transverse opposite edges 34, 36 are then liable to be translated flush with the front face 29 of the support plate 30. Therefore, it is understood that the lengthening of the on-bottom pipeline 12, due to an increase in the temperature of the liquid or of the hydrocarbon passing through the pipeline, will then push back the carriage 20 in a direction V opposite the on-bottom pipeline 12 and, consequently, one edge 34 of the two transverse opposite edges will break the rods 28. If the temperature of the hydrocarbon drops back to a normal operating temperature, then the on-bottom pipeline 12 retracts, and drives the carriage 20 in an opposite direction P.

Figure 3:
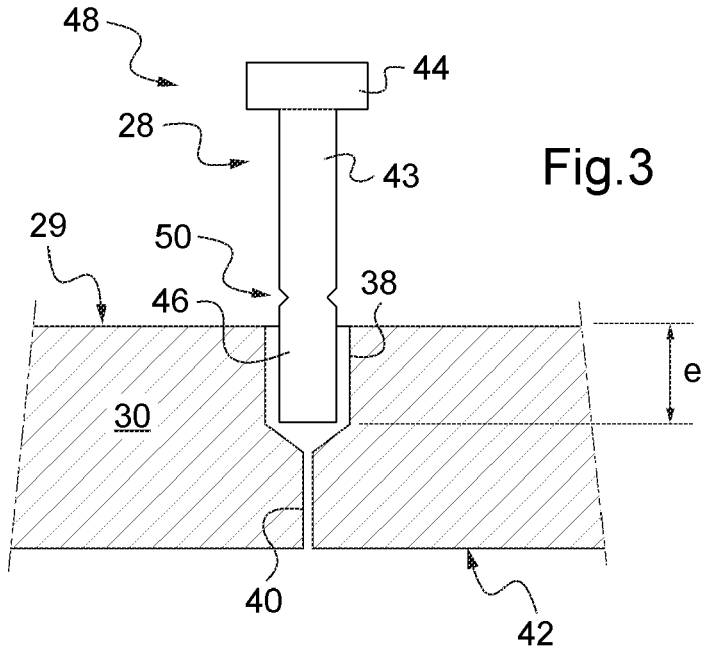
FIG. 3 is a schematic view of a second detailed element of the first detailed element shown in FIG. 2, and according to a perpendicular.

Reference will now be made to FIG. 3 in order to describe in greater detail the method of fixing the rods 28 on the support plate 30. FIG. 3 shows a partial view of the support plate 30 with the front face 29 thereof in which a tapped opening 38 is provided in a substantially perpendicular manner. This opening has a depth e, that is less than half the thickness of the plate 30, and it is extended by a channel 40 that opens onto a back face 42 of the support plate 30. Furthermore, the rod 28 is made up of a threaded rod 43 with a screwing head 44 on top. The rod 28 has an end 46 screwed into the opening 38 and a free end supporting the screwing head 44. It will be seen that the screwing head 44 precisely enables the end 46 to be screwed into the opening 38. Furthermore, the threaded rod 43 has a groove 50 with a depth of approximately 2 mm, forming a notch between the end 46 engaged in the support plate 30 and the free end 48. This groove 50, which forms an incipient fracture, enables an easier break, with less force, of the threaded rod 43 when one of the transverse opposite edges 34, 36 strikes the free end 48 of the rod 28. Furthermore, the channel 40 enables the opening 38 to be brought to hydrostatic pressure when the support plate 30 that is provided with the rods 28 thereof is installed in the sea bed. In this manner, the breaking of the threaded rod 43 is even more brittle.

Figure 2:
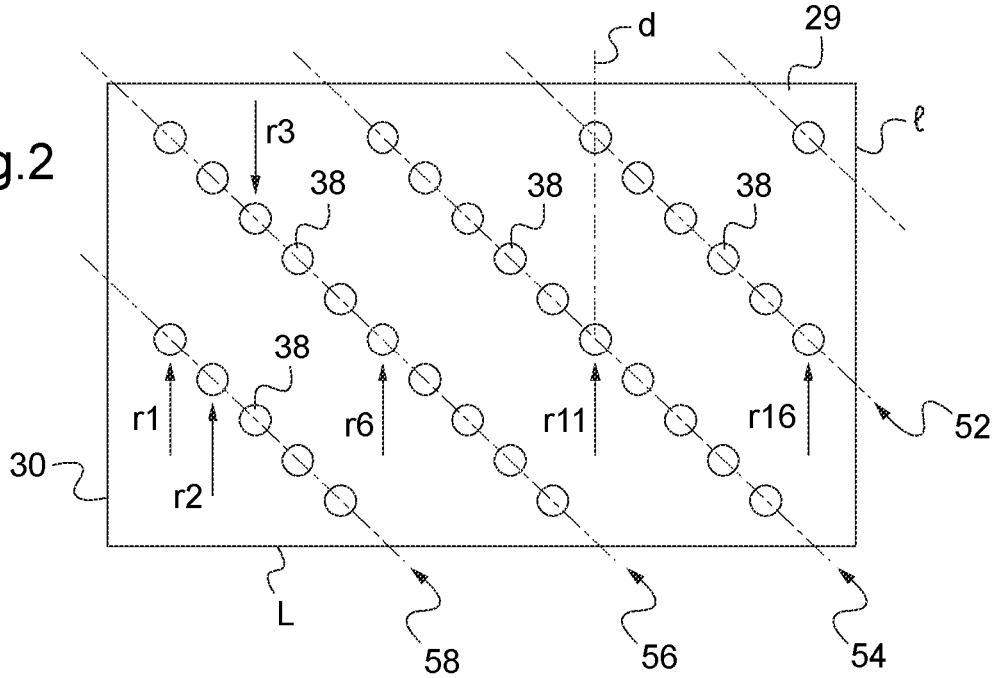
FIG. 2 is a top schematic view of a first detailed element of the device illustrated in FIG. 1.

Reference will now be made to FIG. 2, which illustrates, from above, the support plate 30, though which a plurality of openings 38 is made, with a specific geometry as will be described hereafter. As an example, this support plate 30 has a width W of 340 mm for a length L of 500 mm and a thickness of 50 mm. The tapped openings 38, made in the support plate 30, have a diameter of 15 mm. Above all, they are made in a series of lines 52, 54, 56, 58 that are parallel with each other and slanted at 90° in relation to the length L of the support plate 30. Along the lines thereof, the openings 38 are spaced apart from each other by a distance of approximately 35 mm, whereas along the length L, the openings 38 are spaced, from one series to another, by a distance of 100 mm. Furthermore, along the width W, there is always two openings 38 of two adjacent series corresponding, which define a row d that is parallel with the width W. The collection of the openings 38 extends in a mean direction that is substantially parallel with the length L.

Therefore, each of the openings 38 of the 32 openings in total shown in FIG. 2, of the support plate 30, have a rod 28 of the type illustrated in FIG. 3 screwed therein. Furthermore, the screwing heads 44 are colored with a color that is distinct from the color of the sea bed.

Thus, returning to the embodiment illustrated in FIGS. 1A and 1B, where the carriage 20 is translated over the accommodating support 18 in the direction V opposite the on-bottom pipeline 12, the transverse edge 34 of the window 32 would then simultaneously press against the two rods of the first row r1 of the support plate 30 illustrated in FIG. 2, and would also, as the carriage 20 moves, break them simultaneously by shearing at the groove 50. While continuing the travel thereof, the transverse edge 34 of the window 32 would then press simultaneously against the two rods of a second row r2 adjacent to the first row r1 in order to break them in turn.

The same applies to the following rows, r3 up to r16, assuming that the amplitude of movement of the carriage 20 is substantially equal to the length L of the support plate 30. The rows of rods 28 are evenly spaced from each other by a value of 20 mm. The presence of two rods per row limits the risk of a rod being wrongly broken by the relative movement of the carriage 20 and the accommodating support 18. If this risk does not exist, it is pointless keeping two rods 28 per row; if however there is a considerable risk, it is appropriate to provide more than two rods 28 per row.

In reality, the support plate 30 is oversized so that a certain number of rods 28 can be kept intact on the support plate 30, and they can be viewed thanks to the colored screwing head 44 thereof, compared to the already broken rods. Therefore, when the on-bottom pipeline 12 is put into operation, for a determined period, for example 12 months, the carriage 20 will have been able to move back and forward on the accommodating support 18 depending on the temperature of the hydrocarbon which flowed inside over time, and reach a maximum amplitude corresponding to a maximum of rows of broken rods 28.

In this manner, when, after 12 months, the support plate 30 is inspected by means of a viewing camera, the number of rows of intact rods remaining in relation to the initial number of rows is then observed, and the maximum amplitude of the movement of the carriage 20, and consequently of the connecting end 22, is deduced therefrom. In the example shown in FIG. 2, in the case where, for example, seven rows, r1 to r7, of rods 28 have disappeared, while the other rows are intact, it is deduced therefrom that the maximum excursion, or maximum amplitude, of the carriage 20 on the accommodating support 18, is 140 mm.

Figure 4:
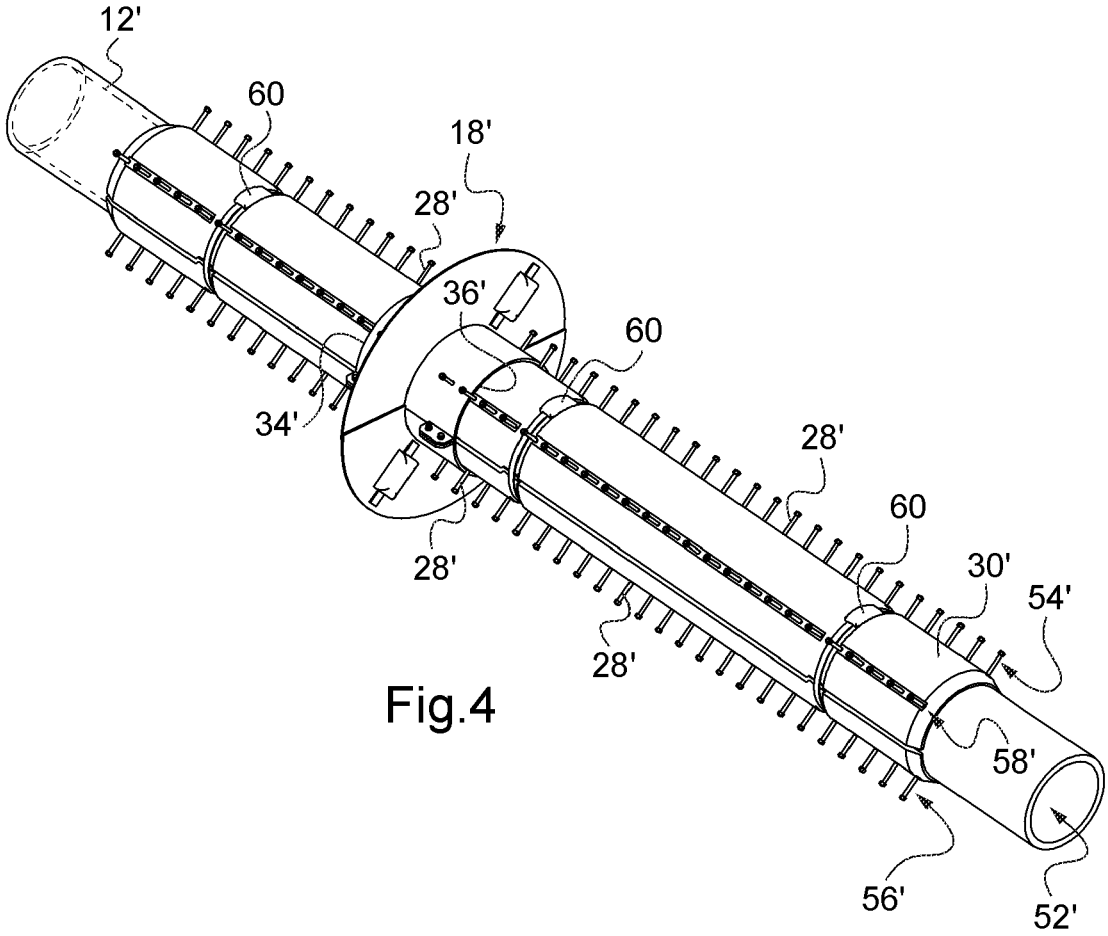
FIG. 4 is a perspective schematic view of the device in accordance with the invention, according to a second alternative.

Reference will now be made to FIG. 4 which illustrates a second alternative of the invention, according to which the frangible elements, which are also formed by rods, are no longer secured to the accommodating support 18 but to the on-bottom pipeline.

With the aim of facilitating the description of this alternative, the similar elements of the measuring device which were illustrated in the previous figures, and which have the same functions, have the same reference assigned with a prime mark: "'".

Therefore, FIG. 4 shows an on-bottom pipeline 12' portion engaged in a longitudinal sleeve 30'. This longitudinal sleeve is kept in a fixed position on the on-bottom pipeline 12' via clamps 60. Furthermore, four lines 52', 54', 56', 58' of rods that are respectively diametrically opposite in twos are screwed into the thickness of the longitudinal sleeve 30'.

The accommodating support is made up of a ring 18' provided with a border which surrounds it in a secured manner. This ring 18' is anchored on the sea bed by partially burying said border. It is then mounted in a fixed position in relation to the sea bed. Alternatively, it can be installed on a base that is not shown. The ring 18' allows the longitudinal sleeve 30' to slide when the latter is driven by the on-bottom pipeline 12'. Furthermore, the ring 18' has two circular opposite shearing edges 34', 36' that are intended to break the rods 28' when the sleeve 30' is translated through the ring 20'.

Moreover, according to yet another alternative of the invention that is not shown, where the aim is to measure not exclusively the longitudinal deformations of an on-bottom pipeline but rather the lateral deformations thereof, the carriage that is translationally moveable on an accommodating support can be installed in a direction that is transverse to the on-bottom pipeline. In this manner, the lateral movements of the pipeline cause movement of the moveable carriage, which, itself, causes the frangible elements to break.

Of course, the embodiments described above are in no way limiting, and any other embodiment can be envisaged. In particular, such a measuring device can be installed between two interconnected on-bottom pipelines.

The invention claimed is:

1. A device for measuring the movement of a subsea deformable pipeline in relation to a seabed, said measuring device comprising an accommodating support anchored in said seabed to accept said subsea deformable pipeline, said subsea deformable pipeline being configured to move over a determined travel with respect to said accommodating support when said pipeline deforms, said movement having an amplitude that varies according to the deformation of said subsea pipeline;

a plurality of frangible elements each secured to at least one of said subsea deformable pipeline and said accommodating support, said plurality of frangible elements extending in and being arrayed along a mean direction that is substantially parallel with said determined travel of said subsea pipeline;

said frangible elements are configured, oriented and located to be broken in succession by the other of said at least one of said subsea deformable pipeline and said accommodating support when said pipeline is caused to move over said determined travel, such as to measure and indicate said amplitude of said movement as a function of a number of broken said frangible elements.

2. The measuring device as claimed in claim 1, wherein said plurality of frangible elements includes rods, each said rod having an engaged end engaged in a respective one of said at least one of said subsea deformable pipeline and said accommodating support and each said rod having a free end projecting from a respective one of said at least one of said subsea deformable pipeline and said accommodating support.

3. The measuring device as claimed in claim 2, wherein at least some of said rods have a respective notch forming an incipient fracture in said at least some rods.

4. The measuring device as claimed in claim 2, wherein each of said rods is oriented in a direction that is substantially perpendicular to said determined travel.

5. measuring device as claimed in claim 2, wherein said engaged end of each said rod is mounted screwed into its respective said one of either of said subsea deformable pipeline and said accommodating support.

6. The measuring device as claimed in claim 2, wherein said rods are made of plastic.

7. The measuring device as claimed in claim 2, wherein said plurality of frangible elements has at least one line of said rods arrayed in a direction that is between a direction of said determined travel and a direction that is perpendicular to the direction of said determined travel.

8. The measuring device as claimed in claim 1, wherein said frangible elements are secured to said accommodating support, while said subsea deformable pipeline is configured for breaking said frangible elements as said pipeline moves.

9. The measuring device as claimed in claim 8, further comprising a carriage slidingly mounted on said accommodating support, said pipeline being mounted securely to said carriage and said carriage moving along with said pipeline over said determined travel, and said carriage with said pipeline mounted thereon is configured for breaking said frangible elements when said subsea pipeline moves said carriage.

10. The measuring device as claimed in claim 1, wherein said frangible elements are secured to said subsea deformable pipeline, while said accommodating support is configured for breaking said frangible elements as said pipeline moves.

11. The measuring device as claimed in claim 10, further comprising a sleeve fitted tightly around said subsea deformable pipeline and that supports said frangible elements, said sleeve being slidingly mounted inside a ring, and said ring is configured for breaking said frangible elements when said subsea pipeline is moved.

12. A method for measuring the movement of a subsea deformable pipeline in relation to a sea bed, wherein said subsea deformable pipeline is extended over said seabed to transport liquids between two subsea installations, said subsea deformable pipeline being deformable according to the temperature of the liquids transported, said method comprising providing an accommodating support, anchoring said support in said sea bed to accept said subsea deformable pipeline, and mounting said subsea deformable pipeline to said accommodating support, said subsea deformable pipeline being liable to be made to move over a determined travel with respect to said accommodating support when said pipeline deforms, wherein said movement has an amplitude that varies according to the deformation of said subsea pipeline;

securing a plurality of frangible elements to one of either of said subsea deformable pipeline and said accommodating support, arraying said plurality of frangible elements to extend in and along a mean direction that is substantially parallel with said determined travel;

breaking said frangible elements in succession, by the other of either of said subsea deformable pipeline and said accommodating support, when said pipeline is caused to move over said determined travel; and, said amplitude of said movement is indicated as a function of the number of broken said frangible elements.

* * * * *

UNITED STATES PATENT AND TRADEMARK OFFICE

CERTIFICATE OF CORRECTION

PATENT NO. : 8,286,516 B2
APPLICATION NO. : 12/742522
DATED : October 16, 2012
INVENTOR(S) : Sylvain Routeau, Isabelle Clement and Frederic Demanze It is certified that error appears in the above-identified patent and that said Letters Patent is hereby corrected as shown below:

On the title page under item (86), insert, --Date: June 15, 2010--

Signed and Sealed this
Twenty-ninth Day of January, 2013

David J. Kappos

David J. Kappos
*Director of the United States Patent and Trademark Office*